US005673729A

United States Patent [19]

Maina et al.

[11] Patent Number: 5,673,729

[45] Date of Patent: Oct. 7, 1997

[54] YARN FEEDER WITH ADJUSTABLE BRAKING MECHANISM

[75] Inventors: Bruno Maina, Vigliano Biellese; Roberto Bertolone, Ponzone Biellese, both of Italy

[73] Assignee: Nuova Roj Electrotex S.r.l., Biella, Italy

[21] Appl. No.: 495,632

[22] PCT Filed: Feb. 18, 1994

[86] PCT No.: PCT/EP94/00476

§ 371 Date: Aug. 4, 1995

§ 102(e) Date: Aug. 4, 1995

[87] PCT Pub. No.: WO94/20402

PCT Pub. Date: Sep. 15, 1994

[30] Foreign Application Priority Data

Feb. 23, 1993 [IT] Italy ..... MI93A0343

[51] Int. Cl.[6] ..... B65H 51/22; D03D 47/34

[52] U.S. Cl. ..... 139/452

[58] Field of Search ..... 139/452

[56] References Cited

U.S. PATENT DOCUMENTS

| | | | |
|---|---|---|---|
| 4,068,807 | 1/1978 | Jacobsson | 139/452 |
| 4,153,214 | 5/1979 | Savio et al. | 242/47.01 |
| 4,165,049 | 8/1979 | Pejchal et al. | 139/452 |
| 4,785,855 | 11/1988 | Benz et al. | 139/452 |
| 4,926,912 | 5/1990 | Zenoni | 139/452 |
| 5,094,275 | 3/1992 | Shaw et al. | 139/452 |
| 5,181,544 | 1/1993 | Deiuri | 139/452 |
| 5,316,051 | 5/1994 | Zenoni et al. | 139/452 |

FOREIGN PATENT DOCUMENTS

| | | |
|---|---|---|
| 246182 | 11/1987 | European Pat. Off. . |
| 330951 | 9/1989 | European Pat. Off. . |
| 536088 | 9/1992 | European Pat. Off. . |
| 2701718 | 6/1978 | Germany . |
| 2005739 | 4/1979 | United Kingdom . |

*Primary Examiner*—Andy Falik
*Attorney, Agent, or Firm*—Young & Thompson

[57] ABSTRACT

Yarn feeder, especially to feed the weft yarn to gripper or projectile looms, wherein the weft yarn is unwound from a weft yarn reserve wound on a drum, onto the outlet end of which there acts a yarn braking device upstream of an outlet yarn guide. The yarn braking device, centered on the drum axis and adjustable along the drum, comprises a frustoconical braking element having a continuous surface and varying flexibility, especially along its generating lines. The yarn braking device is carried by a stiff ring support to which it is fixed close to its major circumference. The support is in turn fixedly mounted onto a bracket of the yarn feeder, the position of which is adjustable along the drum axis.

10 Claims, 4 Drawing Sheets

YARN FEEDER WITH ADJUSTABLE BRAKING MECHANISM

FIELD OF THE INVENTION

The present invention concerns a weft yarn feeder for gripper or projectile looms having improved characteristics.

BACKGROUND OF THE INVENTION

It is well known to feed the yarn to machines making use thereof, particularly the weft yarn to looms, by means of feeding devices or yarn feeders: such devices are positioned between the spool and the loom, and are meant to temporarily store the weft yarn, facilitating its unwinding from the spool, and to subsequently feed it to the loom insertion members with optimal and preset yarn tension values.

The type of structure universally adopted at present for such feeding devices involves winding the yarn into successive turns around a drum kept stationary, by means of a winding arm moved by an electric motor. Means for detecting the amount or reserve of yarn present on the winding drum are provided to control the running and rotational speed of the motor of the feeding device according to the amount of yarn drawn by the loom, so as to make the yarn unwinding speed from the spool as uniform as possible.

When weft yarn feeders are used on gripper or projectile looms, they comprise at their outlet end yarn braking means, positioned downstream of the reserve winding drum and meant to feed the yarn to the loom with a specific desired tension. Many of the known yarn braking devices act directly on the outlet end of the drum and are positioned upstream of an outlet yarn guide of the feeder, meant to ensure a correct unwinding of the yarn. Most weft yarn feeders make use of braking devices consisting of a plurality of natural or synthetic bristles, fixed to a support in the form of a closed ring carried by a bracket with the capability to move along the main axis of the weft yarn feeder. The plurality of bristles bear with a variable pressure adapted to be preset by adjusting the axial position of the bracket onto the outer periphery of the reserve winding drum of the weft yarn feeder. Other weft yarn braking devices, which are also widely adopted, and act directly onto the outlet end of the feeder drum, make use of a braking element with varying flexibility. Such braking elements comprises a plurality of thin strips positioned side-by-side onto a frustoconical surface. This braking element is mounted onto a cup support having an open bottom, carried by a bracket of the yarn feeder and whose position is adjustable along the drum axis.

In weft yarn feeders adopting the above-mentioned braking devices, though the conditions of weft insertion into the loom have been improved, it has not been possible to fully and efficiently solve the problem concerning the optimal control of the tension of the weft yarn being fed to the loom.

This problem is particularly felt in the weft insertion cycle in gripper looms with weft yarn exchange at the center of the shed, wherein yarn tension needs to be kept at a high level at the moment in which the yarn is caught by the carrying gripper, at the inlet of the shed, and at the moment in which the leading end of the yarn exchanges from the carrying gripper to the drawing gripper at the center of the shed.

Now, the drawback of weft yarn feeders adopting the known yarn braking devices, considered heretofore, is that they tend to allow yarn tension to drop below the required levels when weft yarn exchange takes place. Attempts have been made to overcome this drawback by increasing the value of the preset tension, but this unfortunately means raising the top tension value when, to the preset tension produced by braking, there is added the tension produced by inertia of the yarn, at the moment of maximum acceleration of the grippers, before and after weft yarn exchange.

The tension peaks determined by the above situation are obviously undesirable, in that they cause high stresses on the weft yarn, which may easily result in its breakage.

Hence, there is a demand for weft yarn feeders which—while keeping the tension of the weft yarn being fed as low as possible, for an efficient working of the loom—are capable of eliminating the harmful yarn tension peaks (and, obviously, the equally harmful tension drops), while simultaneously guaranteeing the best operating conditions when gripping and exchanging of the weft yarn take place.

For this purpose, applicants have already conceived weft yarn braking devices adopting a special type of braking element which, for its elastic characteristics and thanks to the self-adjusting action allowed by the particular configuration of its support, has proved to be in a position to guarantee during weft insertion a weft yarn tension trend with no harmful peaks and to thus ensure a good result in the weft insertion process. These devices are described in International publications WO 94/10075 and WO 94/12420 by the same applicants.

SUMMARY OF THE INVENTION

A tension diagram which guarantees steadfastness in the braking, without the presence of any tension peaks or drops, is now obtained—in the weft yarn feeder according to the present invention—by means of a weft yarn braking device, whose braking element is of simpler structure than those of the aforecited patent applications, is easier to mount on the yarn feeder, and also provides the advantage of not retaining any loose fibers produced by yarn unwinding at high speed, thanks to its particular shape having a smooth and continuous surface.

This weft yarn braking device differentiates itself also from the other known braking devices, like the ones applied on the weft feeders of EP-246182 or of EP-330951. The weft feeders of these documents use in fact weft yarn braking devices, which brake the weft yarn in a discontinuous manner, acting on the yarn with separated laminae or tongues of the braking element thereof.

In fact, the present invention concerns a weft yarn feeder for gripper or projectile looms of the type in which the weft yarn being fed to a loom is unwound from a weft yarn reserve wound on a drum of the weft feeder, onto the drum's outlet end, where a first yarn deviation takes place. A yarn braking device acts of the weft feeder upstream of an outlet yarn guide of the weft feeder, where a second yarn deviation takes place. The yarn braking device which is centered on the drum axis and adjustable along the drum of the weft feeder, comprises a frustoconical braking element with continuous surface and varying flexibility, carried by a stiff ring support of the weft feeder to which it is fixed close to its major circumference. The support is in turn fixedly mounted onto a slide of the weft feeder. The position of the slide is adjustable along the drum axis. The frustoconical braking element has a varying flexibility, especially along its generating lines.

Advantageously, the frustoconical braking element is in the form of an elastic annular membrane having, close to its minor circumference, a strictly continuous wearproof inner surface.

In this weft yarn feeding device, the outlet yarn guide is positioned along the drum axis, at a distance from the outlet end of the drum such that the unwinding weft yarn leaves the drum without engaging the edge of the braking element corresponding to its minor circumference, or alternatively, it leaves the drum by positively engaging this edge. In the second case, in which an intermediate deviation is imparted on the yarn between the first and second deviations, one can also provide for the yarn to positively engage the edge with an adjustable strength.

BRIEF DESCRIPTION OF THE DRAWINGS

The invention is now described in further detail, by mere way of example, with reference to some preferred embodiments thereof, illustrated on the accompanying drawings, in which.

DETAILED DESCRIPTION OF THE INVENTION

Figure 1:
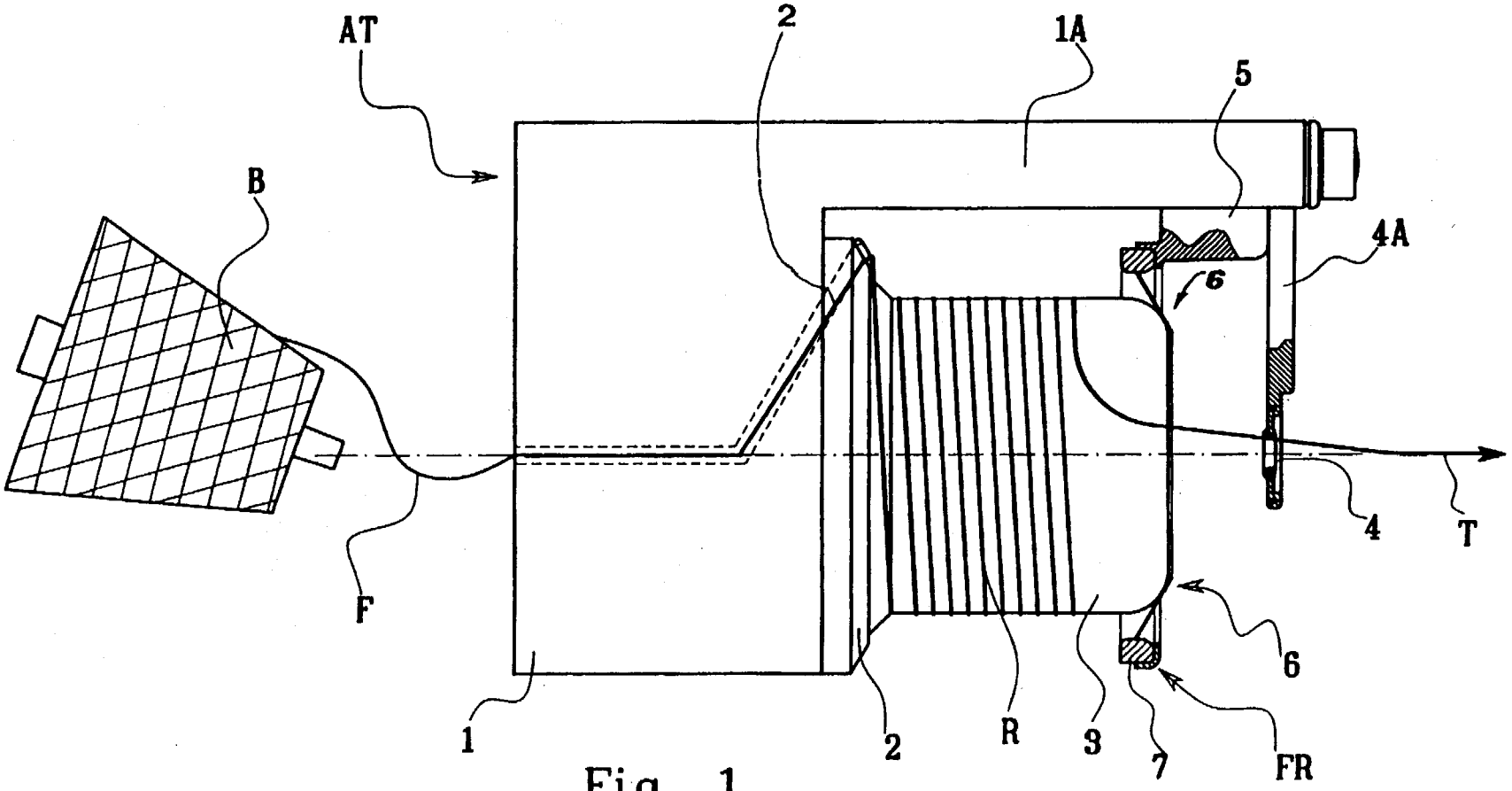
FIG. 1 is a lateral assembly view of a weft yarn feeder according to the present invention.

FIG. 1 shows a weft yarn feeder AT according to the invention, supplied with yarn F from a spool B and intended to feed the yarn as weft T to a gripper or projectile loom (not shown on the drawing).

In known manner, the weft yarn feeder comprises a body 1 with an arm 1A projecting therefrom. A reserve R of weft yarn F is wound into turns, by a winding element 2, around a drum 3 kept stationary, the axis of which is parallel to the arm 1A.

The weft yarn T is unwound from the reserve R, guided by an outlet yarn guide 4 after having been braked in correspondence of the outlet end of the drum 3. The weft yarn guide 4 is carried downstream of the drum 3 and centered along its axis by a bracket 4A projecting from a slide 5 carried by the arm 1A, and whose position is adjustable along the arm. The consistency of the reserve R can be regulated by varying the speed and the operating times of the winding element 2.

In the aforedescribed yarn feeder, the braking of the weft yarn T, at the outlet of the drum 3, is obtained by means of a braking device FR, carried by the slide 5 and comprising a braking element with a frustoconical surface 6 which tangentially engages the peripheral end of the drum 3 in order to brake the yarn—with a strength which can be varied by adjusting, in known manner, the position of the slide 5 along the arm 1A.

The braking element 6 of the yarn feeder according to the invention consists of an annular frustoconical membrane of elastic material—typically rubber—fixed, in correspondence of its major circumference, to a stiff ring support 7 which is in turn carried by the slide 5. According to the invention, the membrane forming the frustoconical braking element 6 has a varying flexibility, especially along its generating lines.

Figure 2A:
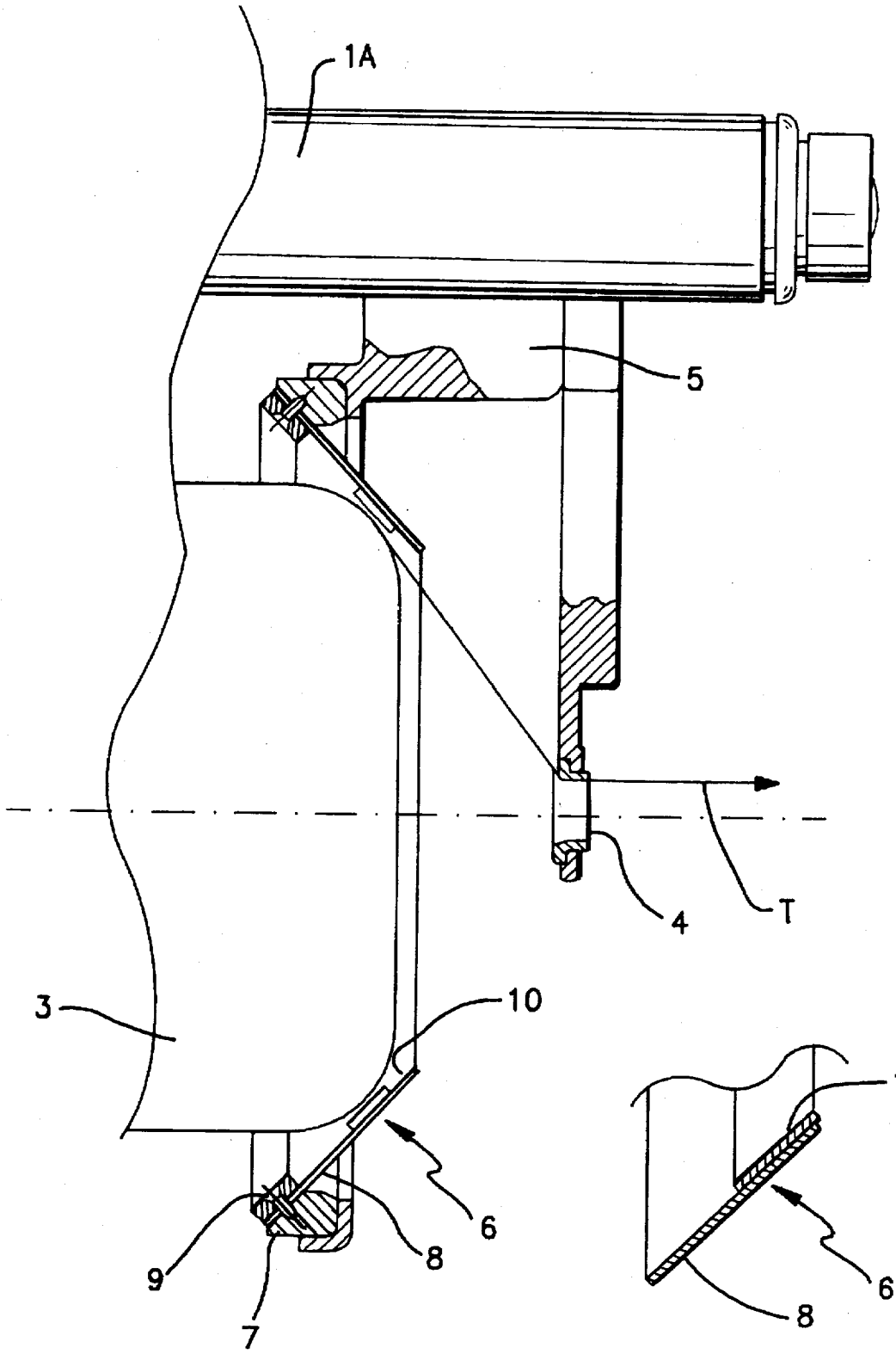
FIGS. 2*a* and 2*b* show a detailed and partly sectioned side view, of a first embodiment of the yarn braking device of the weft feeder show in FIG. 1.
Figure 2B:
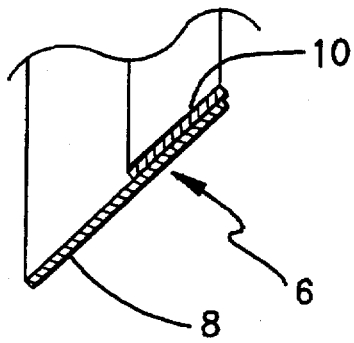

The embodiment of FIG. 2*a* makes use of a strictly frustoconical rubber membrane 8, fixed in correspondence of its major circumference to the stiff ring support 7 by means of screws 9, the inner surface of the membrane 8 being provided with an annular stiffening band 10 in correspondence of its minor circumference. The band 10—suitably, a thin metallic band obtained by drawing—is preferably glued onto the rubber membrane 8. With this band 10, having a strictly continuous wearproof surface, the braking element 6 presses against the end of the drum 3—as is clearly shown in the drawing—so as to brake the weft yarn T as it unwinds from the drum.

In this embodiment, the flexibility of the membrane 8 depends on the characteristics of its material and is influenced by the presence of the band 10, which also allows to vary the flexibility as desired, especially along the generating lines of the frustum of a cone according to which the membrane is configured.

Figure 3:
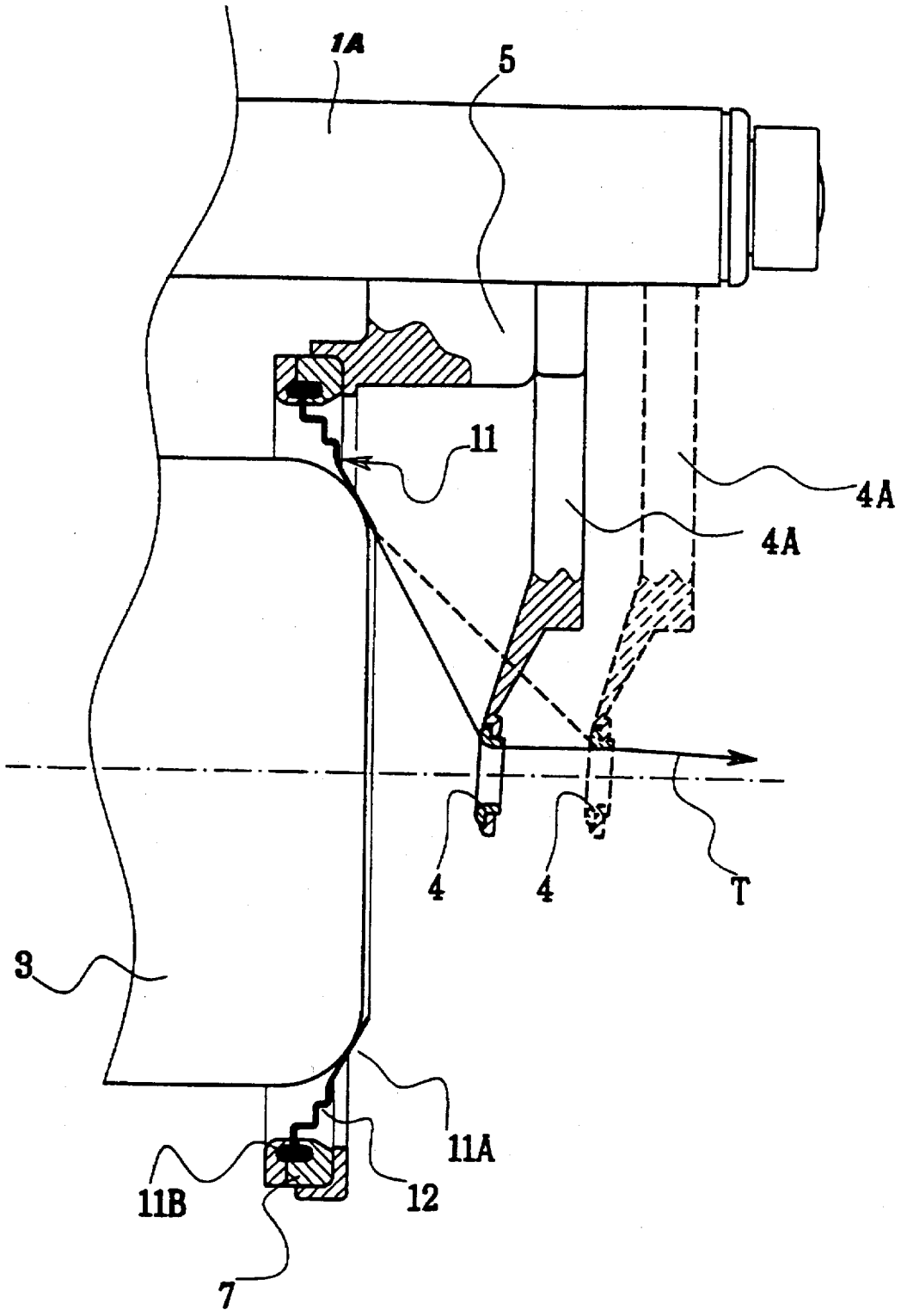
FIGS. 3 and 4 show two further embodiments of the yarn braking device of FIG. 2*a*.

The embodiment of FIG. 3 adopts, instead, a membrane 11 having a strictly frustoconical surface only in its part 11A closest to the minor circumference, while in its part close to the major circumference and to the area of connection to the ring support 7, the frustoconical surface of the membrane is provided with corrugations 12 overlapping directrices of the frustum of the cone according to which the membrane 11 is configured. The membrane 11 is fixed to the support 7 by fitting the thickened end lib thereof into an appropriate, correspondingly shaped, seat formed in the support; the membrane 11 presses against the end of the drum 3 directly with its part 11A, shown without a distinct annular band applied thereon. Also in this case, however, the surface of the membrane part 11A is wearproof and strictly continuous.

In this embodiment, the flexibility of the membrane 11 depends not only on the characteristics of the material forming the same, but also on the presence of the corrugations 12 which corrugate its part closest to the major circumference. These corrugations guarantee a widely varying flexibility, especially along the generating lines of the frustoconical braking element formed by the membrane 11.

Figure 4:
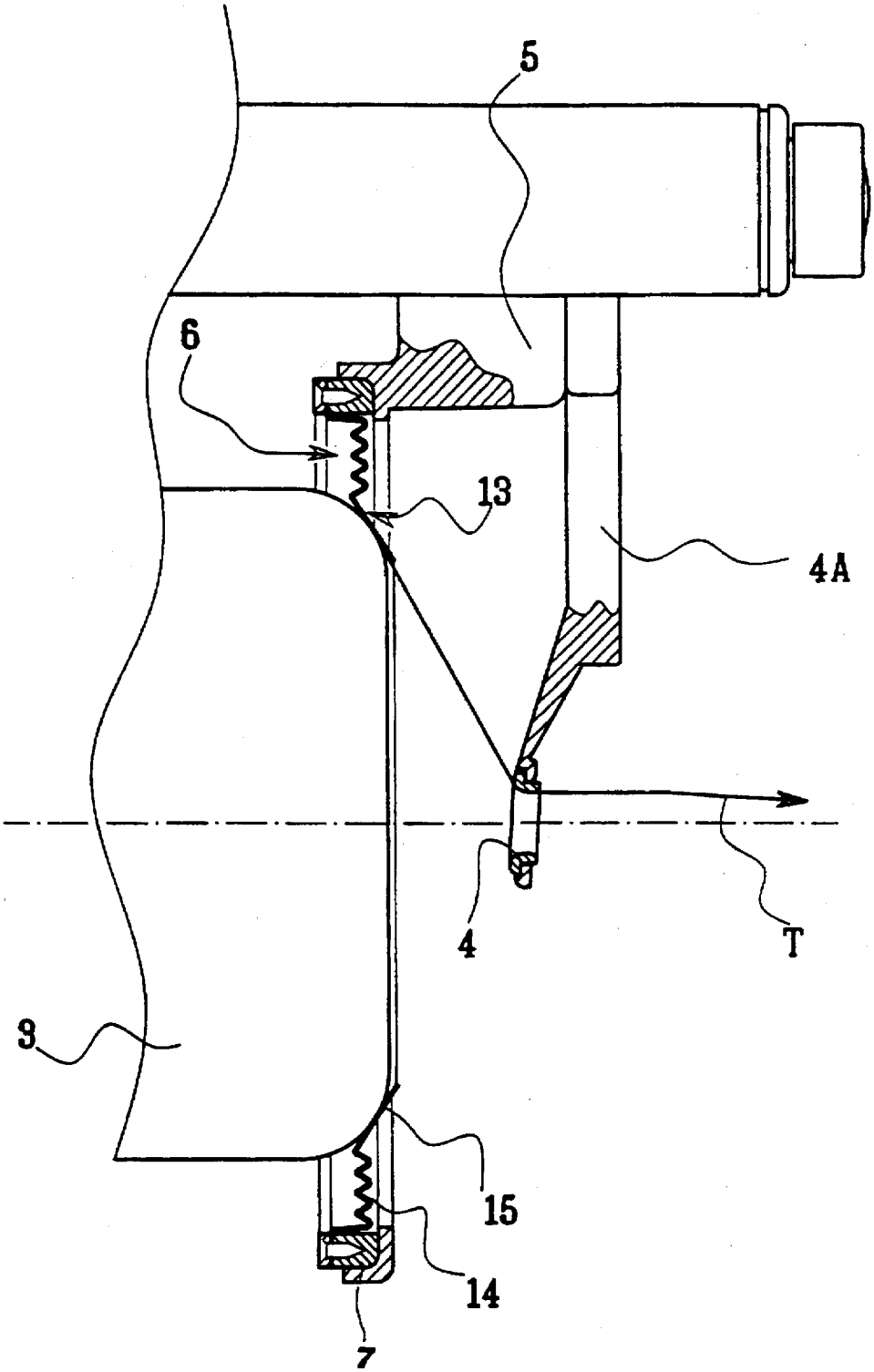

The embodiment of FIG. 4 is modified with respect to that shown in FIG. 3, due to the configuration of the membrane 13, forming the braking element 6, which essentially differs from that of the membrane 11 of the previous embodiment. More precisely, in this embodiment, the braking element does not have its characteristic overall annular frustoconical shape, but the more complex shape of a substantially plane disc 14, corrugated in its part closest to the major circumference and radiused to a flat frustoconical edge 15 in its part close to the minor circumference.

In all three embodiments (FIGS. 2*a*, 3, 4) of the yarn braking device of the invention, the yarn guide 4 (shown in continuous lines) is positioned at a distance from the outlet end of the drum 3 such that the unwinding weft yarn T leaves the drum without engaging the free edge of the braking element 6.

Nevertheless, the yarn guide 4 could alternatively be positioned at a distance from the outlet end of the drum 3, as shown in dashed lines in FIG. 3, such as to cause the unwinding weft yarn T to engage the free end contour of the braking element 6.

These constructive choices are of course left to the designer, according to weaving requirements and to experience.

In addition, it is also possible for the position of the yarn guide 4 to be adjustable with respect to the drum 3 and along its axis: this can be achieved by making the bracket 4A of the yarn guide 4 movable with respect to the slide 5 and, thus, also with respect to the stiff ring support 7 of the braking element 6, fixed to the slide 5. This possibility could for example be realized, as shown in FIG. 3, by suitably shifting the bracket 4A from the position in dashed lines towards the position in continuous lines, or vice-versa, along the axis of the drum 3.

The yarn braking device according to the invention, although of very simple construction—due to the structure of the braking element, formed as a frustoconical annular rubber membrane with varying flexibility, which combines into a single piece the braking portion and the portion supplying the elastic return force, and due to its easy mounting and replacement—is adapted to guarantee an extremely satisfactory tension trend of the yarn being fed. In fact, it not only prevents harmful tension peaks, but it also keeps yarn tension at optimal levels for the requirements of yarn feeding to machines making use thereof. A satisfactory yarn tension is particularly reached when the weft yarn is gripped, exchanged and released by the weft yarn insertion members in gripper or projectile looms.

Of course, other practical embodiments of the invention could be provided, differing from those described. The modifications could concern in particular the materials used for the annular membrane forming the frustoconical braking element with varying flexibility (i.e. plastic materials could be used instead of rubber), the structure and/or configuration of the membrane, the ways and means to fix the membrane to its ring support, and the ways and means to form, or apply on the membrane, the strictly continuous wearproof inner surface, as well as the materials used for the surface (instead of a thin metallic band, obtained by drawing, one could apply bands of resin-bonded cloth, or incorporate highly resisting fibers into a peripheral band of the material forming the membrane). All such modifications, and any other which may be required, fall within the protection scope of the present invention.

We claim:

1. Weft yarn feeder for gripper and projectile looms comprising a drum for storing a weft yarn reserve comprised of turns of a weft yarn wound thereon, said drum having an axis and an outlet end, said weft yarn being unwound from said weft yarn reserve onto said outlet end where a first yarn deviation takes place; a yarn braking device acting on said outlet end, said yarn braking device being positioned upstream of an outlet yarn guide where a second yarn deviation takes place, said yarn braking device being centered on the drum axis, said yarn braking device comprising a frustoconical braking element having a major circumference and a minor circumference, and a continuous surface of varying flexibility along its generating lines; a stiff ring support fixedly mounted onto a slide of the weft feeder for carrying the yarn braking element close to said major circumference, said slide including means for adjusting its position along the drum axis thereby adjusting the position of the braking device along the drum.

2. Weft yarn feeder according to claim 1, wherein said frustoconical braking element is in the form of an elastic annular membrane having close to its minor circumference, a continuous wearproof inner surface.

3. Weft yarn feeder according to claim 2, wherein said wearproof inner surface of the annular membrane forming the frustoconical braking element includes, inside said elastic membrane, an annular frustoconical flexible stiffening band having a continuous surface.

4. Weft yarn feeder according to claim 3, wherein the annular frustoconical flexible stiffening band is glued to the inner surface of the braking element, with a braking surface being provided on said band.

5. Weft yarn feeder according to claim 3, wherein the annular frustoconical flexible stiffening band is made of a thin band of metal or metal alloy.

6. Weft yarn feeder according to claim 3, wherein the annular frustoconical flexible stiffening band consists of a resin bonded cloth.

7. Weft yarn feeder according to claim 3, wherein a minor diameter of the frustoconical flexible stiffening band projects inwardly from a minor diameter end of the frustoconical braking element.

8. Weft yarn feeder according to claim 1, wherein said frustoconical braking element has a first frustoconical surface in a part closest to the minor circumference, and a second frustoconical surface having one or more corrugations overlapping directrices of said surface in a part close to the major circumference where the braking element is connected to said support.

9. Weft yarn feeder according to claim 1, wherein the outlet yarn guide includes means for being supported at a distance from the outlet end of the drum, such that the unwinding weft yarn leaves the drum without engaging the edge of the frustoconical braking element corresponding to its minor circumference.

10. Weft yarn feeder according to claim 1, wherein the frustoconical braking element is an annular membrane made of rubber or a rubber-like plastic material.

* * * * *